US011066286B1

(12) United States Patent
Mullenaux

(10) Patent No.: US 11,066,286 B1
(45) Date of Patent: Jul. 20, 2021

(54) WATER DISPENSING SYSTEM FOR FURNITURE

(71) Applicant: Thomas Mullenaux, San Pedro, CA (US)

(72) Inventor: Thomas Mullenaux, San Pedro, CA (US)

( * ) Notice: Subject to any disclaimer, the term of this patent is extended or adjusted under 35 U.S.C. 154(b) by 0 days.

(21) Appl. No.: 16/827,794

(22) Filed: Mar. 24, 2020

Related U.S. Application Data

(63) Continuation-in-part of application No. 16/519,213, filed on Jul. 23, 2019, now Pat. No. 10,626,581.

(51) Int. Cl.

| | |
|---|---|
| ***B67D 1/00*** | (2006.01) |
| ***B67D 1/08*** | (2006.01) |
| ***A47C 7/72*** | (2006.01) |
| ***A47C 7/62*** | (2006.01) |
| ***A47C 21/00*** | (2006.01) |

(52) U.S. Cl.
CPC ..... *B67D 1/0014* (2013.01); *A47C 7/624* (2018.08); *A47C 7/72* (2013.01); *A47C 21/00* (2013.01); *B67D 1/0894* (2013.01); *B67D 2210/00068* (2013.01)

(58) Field of Classification Search
USPC ..... 222/192; 137/374
See application file for complete search history.

(56) References Cited

U.S. PATENT DOCUMENTS 3,120,404 A * 2/1964 Bramming ..... A45F 3/46 297/118
3,560,047 A * 2/1971 Davis ..... A47C 7/62 297/188.08
3,745,596 A * 7/1973 Copeland ..... A47C 17/86 5/308
4,196,081 A * 4/1980 Pavia ..... C02F 1/28 210/94
4,420,097 A * 12/1983 Motsenbocker ..... A45F 3/16 222/131
4,533,050 A * 8/1985 Bake, Jr. ..... A45C 9/00 206/217
D293,393 S * 12/1987 Bothun ..... D6/335
4,757,921 A * 7/1988 Snowball ..... C02F 9/005 222/146.6
4,871,069 A * 10/1989 Guimont ..... A45C 9/00 206/545
5,046,529 A * 9/1991 Corella ..... E03B 11/06 137/590.5
5,090,075 A * 2/1992 Larson ..... A47C 27/085 141/114
5,106,512 A * 4/1992 Reidy ..... B01D 5/0039 210/744
5,146,633 A * 9/1992 Kim ..... A47C 21/048 5/284
5,149,446 A * 9/1992 Reidy ..... B01D 5/0039 210/744

(Continued)

*Primary Examiner* — Paul R Durand
*Assistant Examiner* — Michael J. Melaragno
(74) *Attorney, Agent, or Firm* — Kyle A. Fletcher, Esq.

(57) ABSTRACT

The water-dispensing system for furniture further includes a plurality of vessel structures. Each of the plurality of vessel structures is a mechanical structure that contains the water in preparation for consumption. The plurality of vessel structures automatically refills the water after the water has been consumed.

18 Claims, 7 Drawing Sheets

(56) References Cited

U.S. PATENT DOCUMENTS 5,248,417 A * 9/1993 Reid ..... B01D 24/007 210/195.1
D342,393 S * 12/1993 Cephas ..... D6/384
5,271,837 A * 12/1993 Discepolo ..... B01J 39/04 210/282
5,553,459 A * 9/1996 Harrison ..... E03B 3/28 62/93
5,722,596 A * 3/1998 Dome ..... A47C 1/14 239/289
5,772,075 A * 6/1998 Ash, Jr. ..... B67D 1/04 222/1
5,992,684 A * 11/1999 Russell ..... B67D 1/006 222/1
6,058,718 A * 5/2000 Forsberg ..... C02F 1/008 62/125
6,230,513 B1 * 5/2001 Reinmuth ..... B67D 1/0857 222/146.6
6,253,394 B1 * 7/2001 Goyette ..... A47K 1/02 4/626
6,354,342 B1 * 3/2002 Gagliano ..... B67D 1/0006 141/82
6,378,546 B1 * 4/2002 Hansen ..... E03B 11/06 137/208
6,513,343 B2 * 2/2003 Pahl ..... A47J 41/0061 62/371
6,588,225 B1 * 7/2003 Hodgson ..... F25B 47/022 62/285
6,588,226 B1 * 7/2003 Semrow ..... C02F 9/005 62/291
6,915,924 B1 * 7/2005 Noiseux ..... E03B 7/07 222/64
6,945,063 B2 * 9/2005 Max ..... B01D 5/0042 62/235.1
6,966,464 B2 * 11/2005 Betkowski ..... A47C 1/16 222/192
8,123,290 B1 * 2/2012 Aiken ..... A47C 7/744 297/180.1
8,297,695 B1 * 10/2012 Aiken ..... A47C 7/744 297/180.1
8,302,412 B2 * 11/2012 Tieleman ..... C02F 3/1263 62/150
8,650,892 B2 * 2/2014 Ferreira ..... C02F 3/1221 62/150
8,763,655 B2 * 7/2014 Springer ..... B67D 1/06 141/113
8,777,182 B2 * 7/2014 Springer ..... F16K 27/07 251/129.2
9,016,333 B2 * 4/2015 Shaffer ..... B65D 1/04 141/113
9,284,174 B2 * 3/2016 Springer ..... B65D 1/06
9,440,835 B2 * 9/2016 Springer ..... B65D 1/06
10,161,564 B1 * 12/2018 Delobel ..... A47C 7/62
10,207,910 B2 * 2/2019 Springer ..... A47G 19/2205
10,219,631 B1 * 3/2019 Jimenez ..... A47C 7/622
10,405,670 B1 * 9/2019 Mullenaux ..... B67D 1/0004
10,612,215 B2 * 4/2020 Holbrook ..... E03B 11/02
10,626,581 B1 * 4/2020 Mullenaux ..... A47C 7/72
10,696,530 B2 * 6/2020 Springer ..... B67D 1/0007
10,759,644 B2 * 9/2020 Lim ..... B67D 1/0021
2002/0029580 A1 * 3/2002 Faqih ..... F24F 13/222 62/291
2002/0046569 A1 * 4/2002 Faqih ..... C02F 9/005 62/188
2004/0000165 A1 * 1/2004 Max ..... B01D 5/0042 62/615
2004/0049845 A1 * 3/2004 Gallant ..... A61G 13/107 4/664
2004/0164093 A1 * 8/2004 Redman ..... A47K 5/1205 222/95
2005/0067434 A1 * 3/2005 Yu ..... B67D 3/0032 222/185.1
2005/0284167 A1 * 12/2005 Morgan ..... B01D 5/009 62/272
2006/0288709 A1 * 12/2006 Reidy ..... F25B 21/02 62/3.4
2007/0062972 A1 * 3/2007 Feldman ..... B67D 1/0045 222/129.1
2008/0223478 A1 * 9/2008 Hantsoo ..... B67D 1/0894 141/2
2008/0308176 A1 * 12/2008 Weems ..... B67D 1/07 141/11
2009/0114091 A1 * 5/2009 Blum ..... B03C 3/32 95/72
2010/0025311 A1 * 2/2010 Jones ..... C02F 1/048 210/149
2011/0121020 A1 * 5/2011 Springer ..... A47G 19/2205 222/1
2012/0103926 A1 * 5/2012 Ibsies ..... B65D 1/06 215/228
2012/0111889 A1 * 5/2012 Huff ..... A01G 25/09 222/143
2012/0267298 A1 * 10/2012 Hansen ..... C02F 1/4674 210/198.1
2013/0118639 A1 * 5/2013 Springer ..... A47G 19/2255 141/2
2013/0220906 A1 * 8/2013 Stenhouse ..... E03B 3/28 210/181
2014/0182744 A1 * 7/2014 Shaffer ..... B67D 1/06 141/362
2014/0209634 A1 * 7/2014 Metropulos ..... B67D 1/06 222/129.1
2014/0239014 A1 * 8/2014 Gallaher ..... A45F 3/16 222/173
2014/0332113 A1 * 11/2014 Springer ..... B67C 3/007 141/1
2014/0345721 A1 * 11/2014 Keisel ..... E03B 5/02 137/565.17
2015/0096937 A1 * 4/2015 Munro ..... C02F 1/441 210/652
2015/0097001 A1 * 4/2015 Gatipon ..... B67D 1/0857 222/108
2015/0107281 A1 * 4/2015 West ..... F25D 21/14 62/93
2016/0031694 A1 * 2/2016 Orita ..... B67D 1/07 222/638
2016/0060850 A1 * 3/2016 Johnson ..... E03B 11/06 137/12
2016/0231029 A1 * 8/2016 Pan ..... A47B 79/00
2016/0340165 A1 * 11/2016 Lim ..... B67D 1/0021
2016/0376141 A1 * 12/2016 Springer ..... B67D 1/1272 141/1
2017/0001853 A1 * 1/2017 Park ..... B65D 85/72
2018/0263394 A1 * 9/2018 Thomas ..... A47C 7/664
2018/0332972 A1 * 11/2018 Jaeckel ..... A47C 7/624
2018/0368599 A1 * 12/2018 Delobel ..... A47C 7/622
2018/0370784 A1 * 12/2018 Bolender ..... B67D 1/0082
2019/0010681 A1 * 1/2019 Shi ..... E03B 7/04
2019/0031546 A1 * 1/2019 Hollingsworth ..... C02F 9/00
2019/0153704 A1 * 5/2019 Gido ..... E03B 3/28
2019/0177149 A1 * 6/2019 Springer ..... B67D 1/124
2019/0249400 A1 * 8/2019 Holbrook ..... E03B 11/02
2019/0321784 A1 * 10/2019 Dunham ..... B01D 61/06
2019/0329147 A1 * 10/2019 Enzenhofer ..... B01B 1/005
2021/0039942 A1 * 2/2021 Springer ..... G06Q 20/326

* cited by examiner

WATER DISPENSING SYSTEM FOR FURNITURE

CROSS REFERENCES TO RELATED APPLICATIONS

This non-provisional application is a continuation-in-part application filed under 37 CFR 1.53(b) that claims the benefit of United States 35 USC 120 from non-provisional application U.S. Ser. No. 16/519,213 filed on Jul. 23, 2019 by the inventor: Thomas Mullenaux of San Pedro, Calif.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including sofas and beds, more specifically, a combination of furniture items. (A47C19/22)

Background

This non-provisional application is a continuation-in-part application filed under 37 CFR 1.53(b) that claims the benefit of United States 35 USC 120 from non-provisional application U.S. Ser. No. 16/519,213 filed on Jul. 23, 2019 by the inventor: Thomas Mullenaux of San Pedro, Calif. The non-provisional application U.S. Ser. No. 16/519,213 is itself a continuation-in-part application filed under 37 CFR 1.53(b) that claimed the benefit of United States 35 USC 120 from non-provisional application U.S. Ser. No. 16/140,643 filed on Sep. 25, 2018 by the inventor: Thomas Mullenaux of San Pedro, Calif.

The present disclosure will only reference the elements of the non-provisional application U.S. Ser. No. 16/519,213 that are relevant to the innovations disclosed within this application. This is done for purposes of simplicity and clarity of exposition. The applicant notes that this disclosure incorporates non-provisional application U.S. Ser. No. 16/519,213 in its entirety into this application. The fact that any specific innovation selected from the one or more innovations disclosed within U.S. Ser. No. 16/519,213 is not addressed in this application should not be interpreted as an indication of defect in the above referenced patent.

Within this disclosure, the non-provisional application U.S. Ser. No. 16/519,213 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure comprises a water 910 dispensing system 400 and an item of furniture 777. The water 910 dispensing system 400 extracts and purifies water 910 from the air such that the water 910 dispensing system 400 is self-contained and does not require an external source of water 910.

The prior disclosure is designed for use with a plurality of different types of furniture (see FIGS. 1 and 6 as examples). The item of furniture 777 may be a bed 778, a futon, a Murphy bed, a pull out sofa-bed, a sofa, a couch, a recliner 779, a settee, a chair, or other items of furniture that is typically associated with the above-listed items. The prior disclosure is adapted to dispense the water 910 to occupants of said item of furniture 777 from a water 910 reservoir 430 located in the item of furniture 777.

The prior disclosure comprises the water 910 reservoir 430, a first filter 440, a dehumidifier 530, a second filter 540, a pump 450, a valve 460, a first retractable hose 420, a second retractable hose 425, a first mouthpiece 410, and a second mouthpiece 415. The water 910 stored in the water 910 reservoir 430 flows through the first filter 440 to remove impurities and is pumped to the valve 460. The valve 460 starts and stops the flow of the water 910 to the first mouthpiece 410 via the first retractable hose 420 and to the second mouthpiece 415 via the second retractable hose 425.

The water 910 reservoir 430 is a container for holding the water 910. The water 910 flowing out of the water 910 reservoir 430 is routed to the first filter 440. The first filter 440 removes impurities from the water 910 as the water 910 flows through the first filter 440. As the water 910 passes through the first filter 440 impurities in the water 910 are trapped within the first filter 440 such that the water 910 exiting through the first filter 440 is cleaner than the water 910 that entered the first filter 440. The water 910 flowing out of the first filter 440 is routed to the pump 450.

The dehumidifier 530 condenses humidity from the air passing through the dehumidifier 530 and collects the water 910 from the condensate. The condensed water 910 exits the dehumidifier 530 and passes through the second filter 540 where the condensate is made potable before transport to the water 910 reservoir 430 for storage.

The second filter 540 removes impurities from the water 910 as the water 910 flows through the second filter 540. As the water 910 passes through the second filter 540 impurities in the water 910 are trapped within the second filter 540 such that the water 910 exiting through the second filter 540 is potable.

The pump 450 generates a pressure differential that transports the water 910 from the first filter 440 to the valve 460. The valve 460 controls the flow of water 910 through the first retractable hose 420 to the first mouthpiece 410. The valve 460 controls the flow of water 910 through the second retractable hose 425 to the second mouthpiece 415.

The first retractable hose 420 is a tubing that is pulled out of the item of furniture 777 and that retracts into the item of furniture 777. The second retractable hose 425 is a tubing that is pulled out of the item of furniture 777 and that retracts into the item of furniture 777. The first mouthpiece 410 is adapted to deliver the water 910 from the first retractable hose 420 for consumption while in the item of furniture 777. The first mouthpiece 410 attaches to the end of the first retractable hose 420. The second mouthpiece 415 is adapted to deliver the water 910 from the second retractable hose 425 for consumption while in the item of furniture 777. The second mouthpiece 415 attaches to the end of the second retractable hose 425.

SUMMARY OF INVENTION

The water-dispensing system for furniture is an enhancement to the prior disclosure described in the Background section of this disclosure. The water-dispensing system for furniture comprises the water storage reservoir, the distribution pump, the first retractable hose, the second retractable hose, the first mouthpiece, and the second mouth piece described in the background section of this disclosure.

The water-dispensing system for furniture further comprises a plurality of vessel structures. The water stored in the water reservoir flows through the first filter to remove impurities and is subsequently pumped to the valve. The valve starts and stops the flow of the water to the plurality of vessel structures. The plurality of vessel structures replaces a structure selected from the group consisting of: a) the first mouthpiece; and, b) the second mouthpiece. Each of the plurality of vessel structures is a mechanical structure that contains the drinking water in preparation for consumption. The plurality of vessel structures automatically refills the drinking water after the drinking water has been consumed.

These together with additional objects, features and advantages of the water-dispensing system for furniture will be readily apparent to those of ordinary skill in the art upon reading the following detailed description of the presently preferred, but nonetheless illustrative, embodiments when taken in conjunction with the accompanying drawings.

In this respect, before explaining the current embodiments of the water-dispensing system for furniture in detail, it is to be understood that the water-dispensing system for furniture is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water-dispensing system for furniture.

It is therefore important that the claims be regarded as including such equivalent construction insofar as they do not depart from the spirit and scope of the water-dispensing system for furniture. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
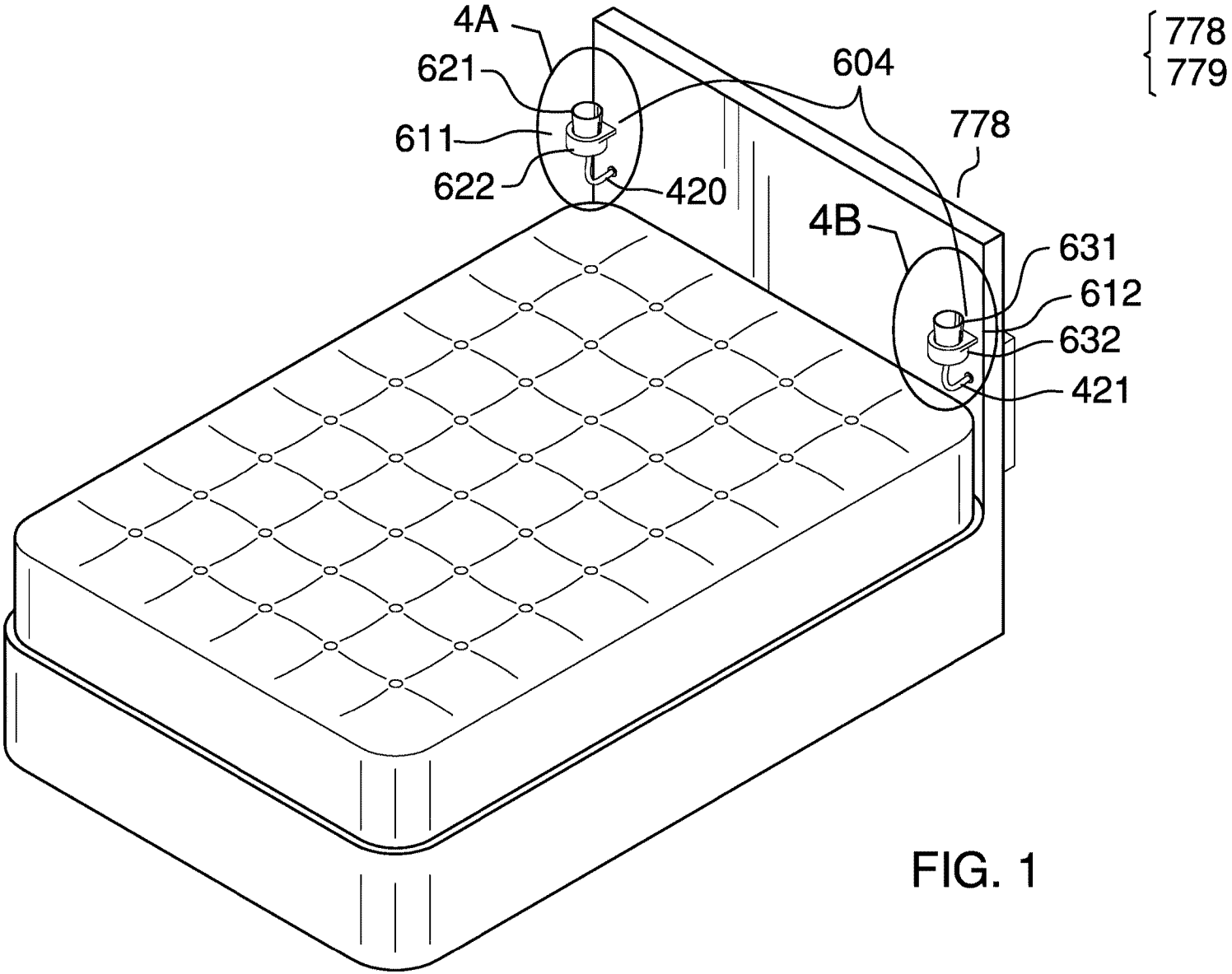
FIG. 1 is a perspective view of an embodiment of the disclosure.
Figure 2:
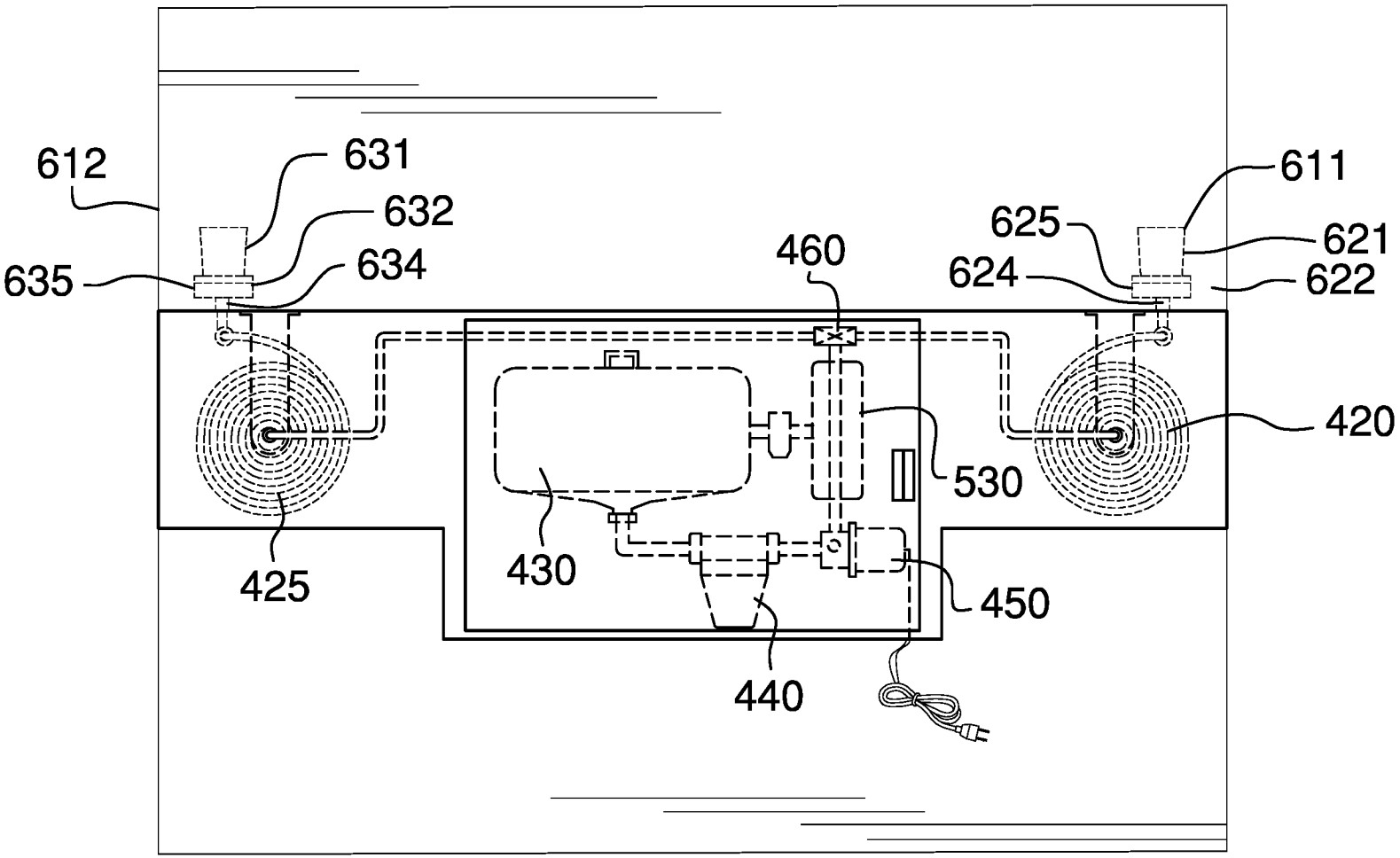
FIG. 2 is a rear view of an embodiment of the disclosure.
Figure 3:
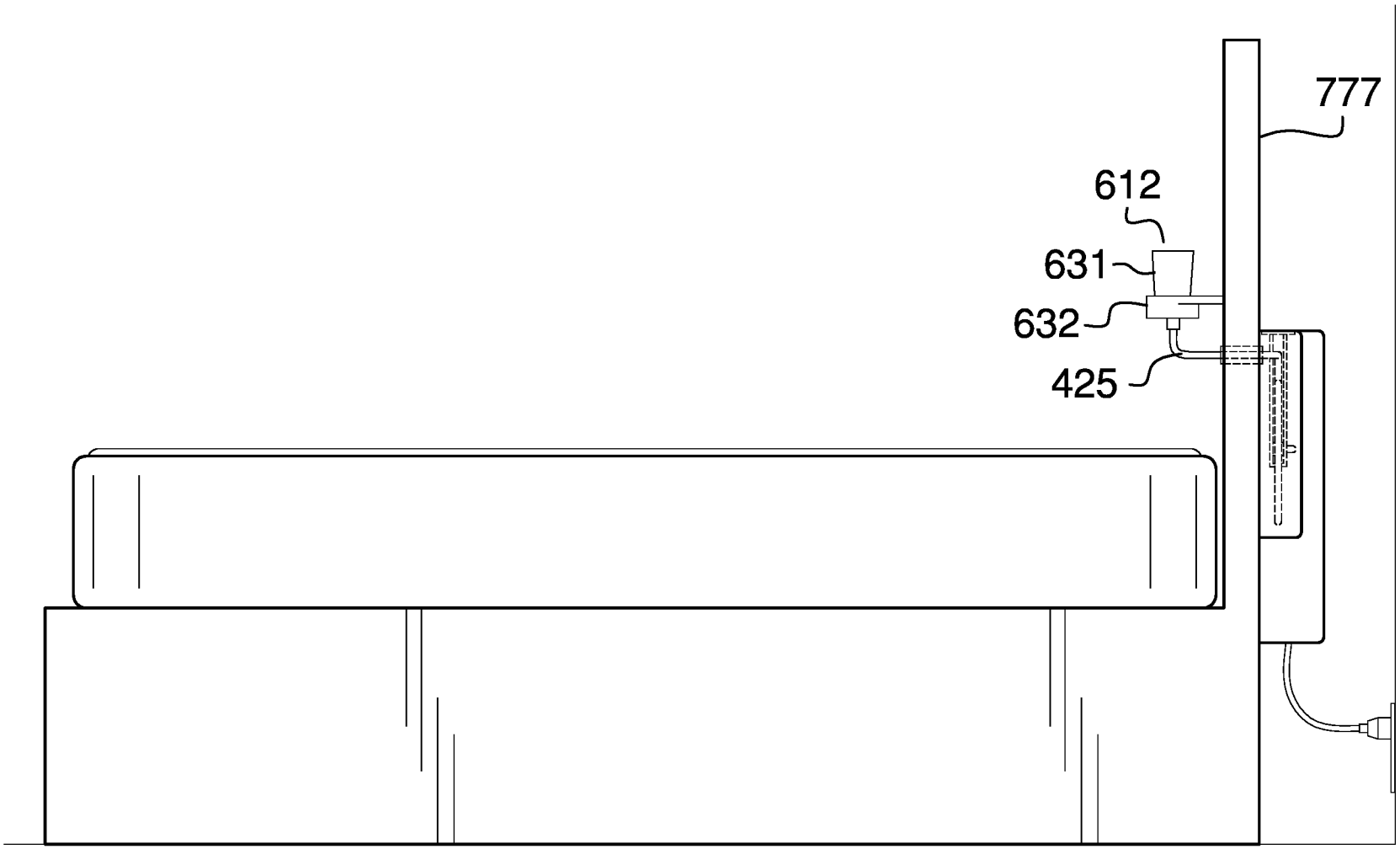
FIG. 3 is a detail view of an embodiment of the disclosure.
Figure 4A:
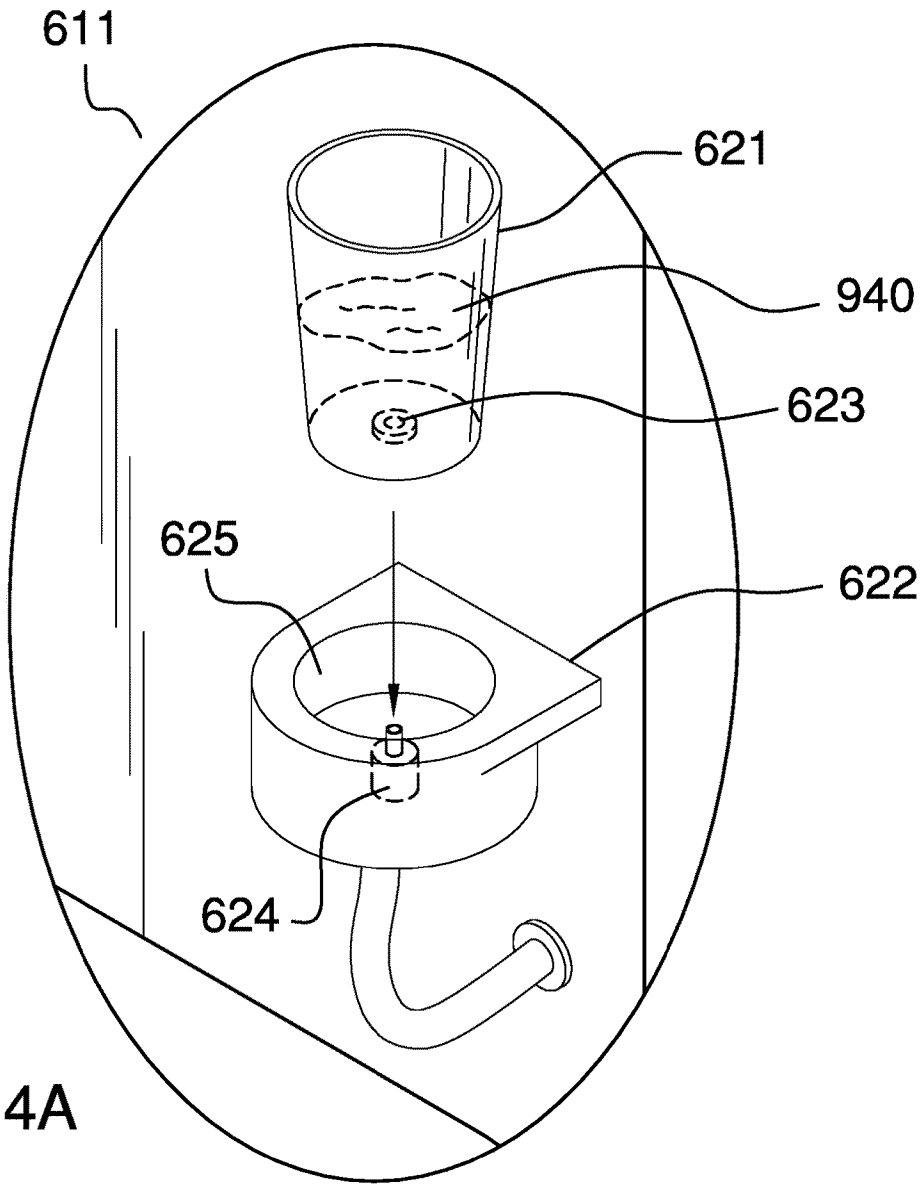
FIG. 4*a* is a detail view of an embodiment of the disclosure.
Figure 4B:
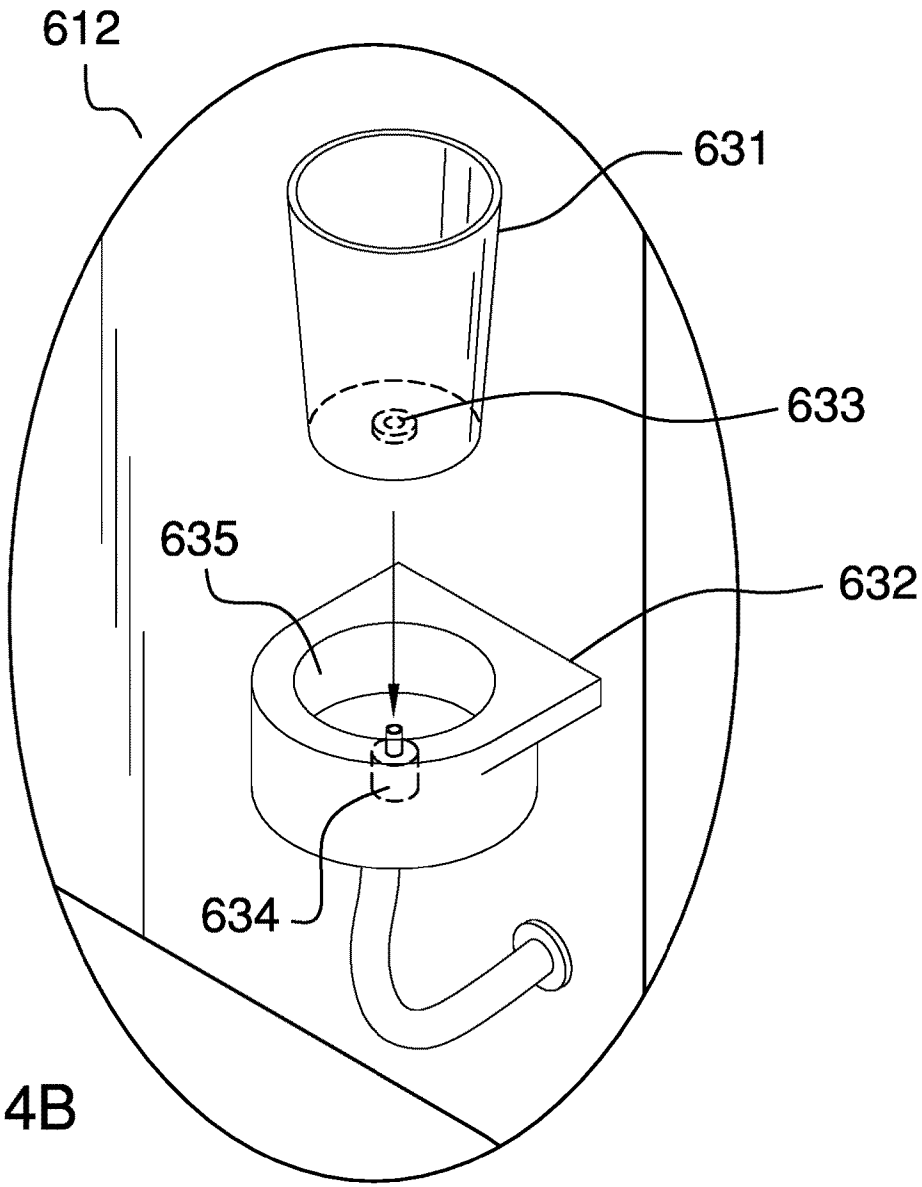
FIG. 4*b* is a detail view of an embodiment of the disclosure.
Figure 5:
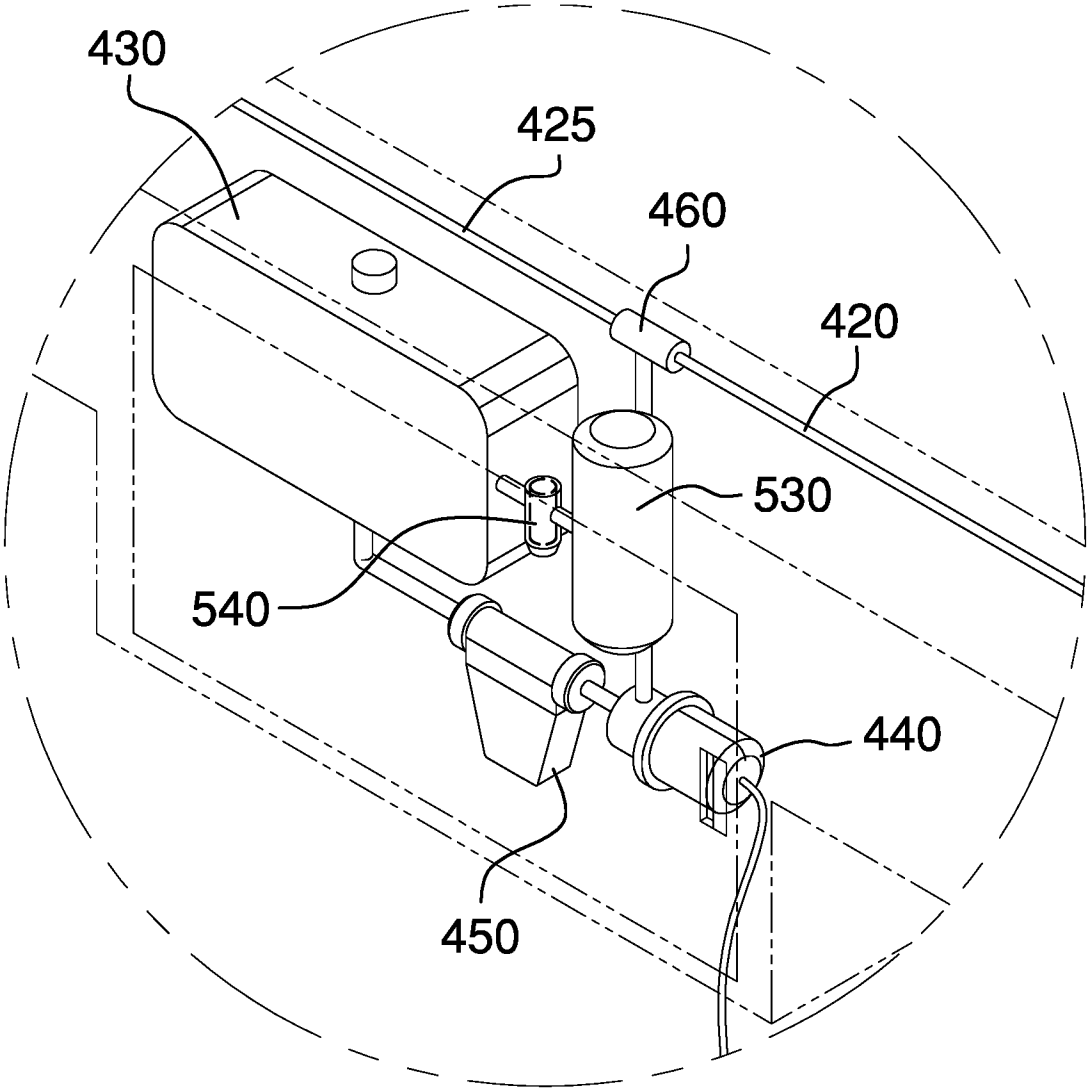
FIG. 5 is a perspective view of an embodiment of the disclosure.
Figure 6:
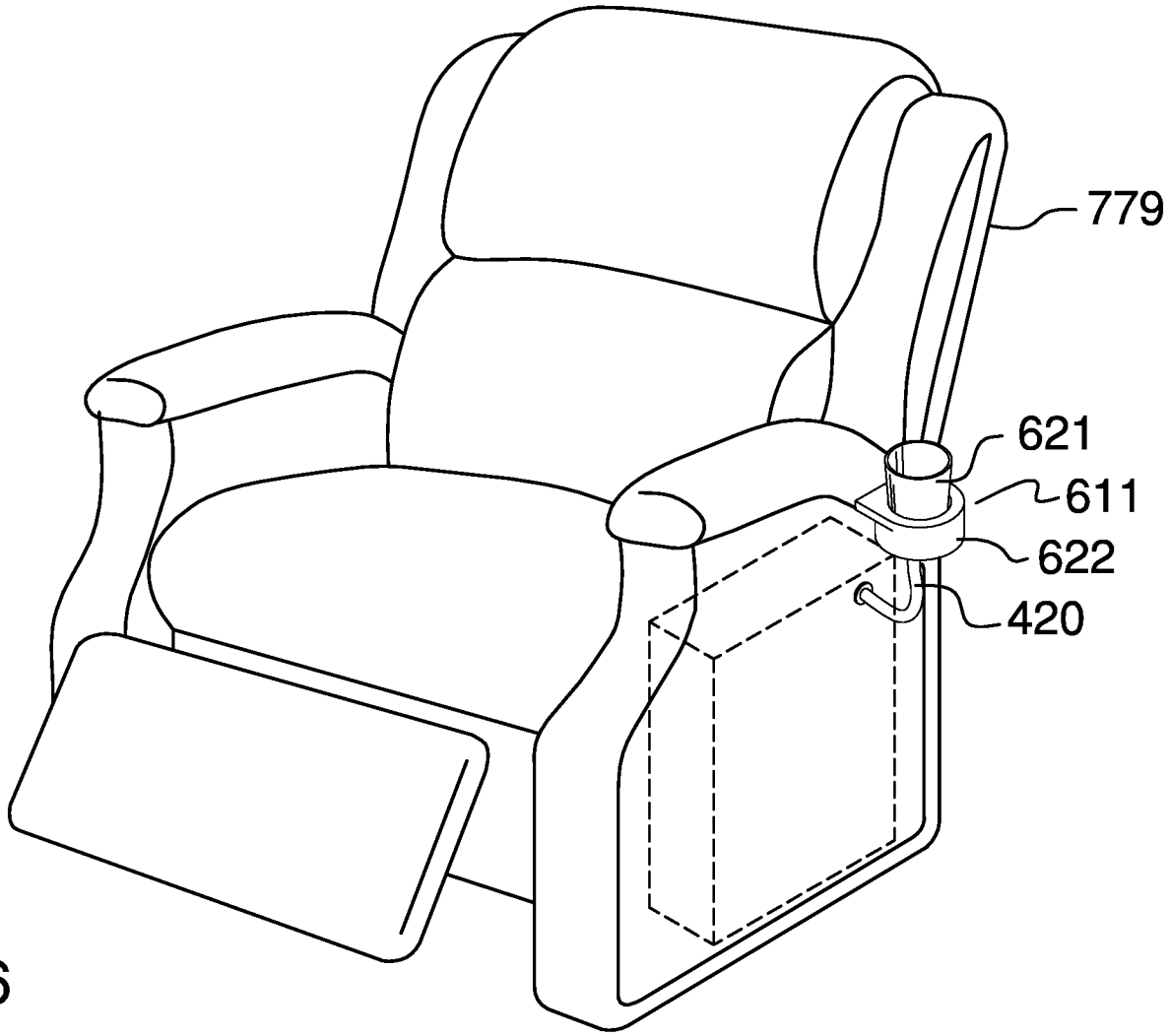
FIG. 6 is a perspective view of an alternate embodiment of the disclosure.

Detailed reference will now be made to one or more potential embodiments of the disclosure, which are illustrated in FIGS. 1 through 6.

This non-provisional application is a continuation-in-part application filed under 37 CFR 1.53(b) that claims the benefit of United States 35 USC 120 from non-provisional application U.S. Ser. No. 16/519,213 filed on Jul. 23, 2019 by the inventor: Thomas Mullenaux of San Pedro, Calif. The non-provisional application U.S. Ser. No. 16/519,213 is itself a continuation-in-part application filed under 37 CFR 1.53(b) that claimed the benefit of United States 35 USC 120 from non-provisional application U.S. Ser. No. 16/140,643 filed on Sep. 25, 2018 by the inventor: Thomas Mullenaux of San Pedro, Calif.

The present disclosure will only reference the elements of the non-provisional application U.S. Ser. No. 16/519,213 that are relevant to the innovations disclosed within this application. This is done for purposes of simplicity and clarity of exposition. The applicant notes that this disclosure incorporates non-provisional application U.S. Ser. No. 16/519,213 in its entirety into this application. The fact that any specific innovation selected from the one or more innovations disclosed within U.S. Ser. No. 16/519,213 is not addressed in this application should not be interpreted as an indication of defect in the above referenced patent.

Within this disclosure, the non-provisional application U.S. Ser. No. 16/519,213 will also be referred to as the prior disclosure.

The water-dispensing system for furniture 100 (hereinafter invention) is an enhancement to the prior disclosure described in the Background section of this disclosure. The prior disclosure comprises the water 910 storage reservoir 430, the pump 450, the valve 460, the first retractable hose 420, the second retractable hose 425, the first mouthpiece 410, and the second mouthpiece 415. The prior disclosure is described in the background section of this disclosure.

The invention 100 further comprises a plurality of vessel structures 604. Each of the plurality of vessel structures 604 replaces a structure selected from the group consisting of: a) the first mouthpiece 410; and, b) the second mouthpiece 415. Each of the plurality of vessel structures 604 is a mechanical structure that contains the water 910 in preparation for consumption. The plurality of vessel structures 604 automatically refills the water 910 after the water 910 has been consumed. The water-dispensing system for furniture is configured for use with an item of furniture. The water-dispensing system for furniture mounts in the item of furniture.

The pump 450 and the valve 460 control the flow of water 910 from the water 910 reservoir 430, through the pump 450 and the valve 460 into the plurality of vessel structures 604. Each of the plurality of vessel structures 604 replaces a mouthpiece selected from the group consisting of: a) the first mouthpiece 410; and, b) the second mouthpiece 415. Each of the plurality of vessel structures 604 is a mechanical structure that contains the water 910 in preparation for consumption. The plurality of vessel structures 604 refills the water 910 after the water 910 has been consumed.

The term water 910 is defined elsewhere in this disclosure. The first mouthpiece 410 is described in the Background section of this disclosure. The second mouthpiece 415 is described in the Background section of this disclosure. The first retractable hose 420 is described in the Background section of this disclosure. The second retractable hose 425 is described in the Background section of this disclosure. The water 910 storage reservoir 430 is described in the Background section of this disclosure. The pump 450 is described in the Background section of this disclosure. The valve 460 is described in the Background section of this disclosure. The item of furniture 777 is described in the Background section of this disclosure.

The plurality of vessel structures 604 is a mechanical structure. The plurality of vessel structures 604 forms a vessel from which the water 910 is consumed. The plurality of vessel structures 604 provides a storage space for the vessel from which the water 910 is consumed. The plurality of vessel structures 604 provides a mechanism that refills the vessel with water 910 after it has been consumed. Each of the plurality of vessel structures 604 mounts in the item of furniture 777 such that the vessel is accessible to an occupant of the item of furniture 777. The plurality of vessel structures 604 further comprises a first vessel 621 structure 611 and a second vessel 631 structure 612.

The first vessel 621 structure 611 is the vessel structure selected from the plurality of vessel structures 604 that replaces the first mouthpiece 410 of the prior disclosure. The first vessel 621 structure 611 further comprises a first vessel 621 and a first vessel 621 holder 622.

The first vessel 621 is a hollow prism-shaped structure. The first vessel 621 is a pan-shaped structure. The first vessel 621 contains the water 910 in a manner suitable for the consumption of the water 910. The open face of the pan structure of the first vessel 621 is formed in a congruent end of the prism structure of the first vessel 621. The first vessel 621 is sized to insert into the first vessel 621 holder 622 for storage. The first vessel 621 structure 611 refills the first vessel 621 with water 910 when the first vessel 621 inserts into the first vessel 621 holder 622. The first vessel 621 further comprises a first vessel 621 valve 623.

The first vessel 621 valve 623 forms a portion of a fitting that attaches the first vessel 621 to the first retractable hose 420 such that the first vessel 621 receives water 910 from the first retractable hose 420. The first vessel 621 valve 623 forms a fluidic connection to the first retractable hose 420 when the first vessel 621 inserts into the first vessel 621 holder 622. The first vessel 621 valve 623 mounts in the closed congruent end of the pan structure of the first vessel 621.

The first vessel 621 holder 622 is a mechanical structure. The first vessel 621 holder 622 mounts in the item of furniture 777 such that the first vessel 621 holder 622 and the first vessel 621 are accessible from within the item of furniture 777. The first vessel 621 holder 622 stores the first vessel 621. The first vessel 621 holder 622 transfers water 910 from the first retractable hose 420 into the first vessel 621. The first vessel 621 holder 622 further comprises a first vessel 621 holder 622 valve 624 and a first vessel 621 holder 622 pan 625.

The first vessel 621 holder 622 valve 624 forms a portion of a fitting that attaches the first vessel 621 to the first retractable hose 420 such that the first vessel 621 receives water 910 from the first retractable hose 420. The first vessel 621 holder 622 valve 624 attaches to the first retractable hose 420. The first vessel 621 holder 622 valve 624 mounts in the closed congruent end of the pan structure formed by the first vessel 621 holder 622 pan 625 such that the first vessel 621 valve 623 inserts into the first vessel 621 holder 622 valve 624 as the first vessel 621 inserts into the first vessel 621 holder 622 pan 625. The insertion of the first vessel 621 valve 623 into the first vessel 621 holder 622 valve 624 forms the fluidic connection that allows the first retractable hose 420 to refill the first vessel 621 with water 910.

The first vessel 621 holder 622 pan 625 is a prism-shaped negative space that is formed in the first vessel 621 holder 622. The first vessel 621 holder 622 pan 625 has a pan structure. The first vessel 621 holder 622 pan 625 is geometrically similar to the first vessel 621. The inner dimension of the first vessel 621 holder 622 pan 625 is greater than the outer dimension of the first vessel 621 such that the first vessel 621 inserts into the first vessel 621 holder 622 pan 625.

The second vessel 631 structure 612 is the vessel structure selected from the plurality of vessel structures 604 that replaces the second mouthpiece 415 of the prior disclosure. The second vessel 631 structure 612 further comprises a second vessel 631 and a second vessel 631 holder 632.

The second vessel 631 is a hollow prism-shaped structure. The second vessel 631 is a pan-shaped structure. The second vessel 631 contains the water 910 in a manner suitable for the consumption of the water 910. The open face of the pan structure of the second vessel 631 is formed in a congruent end of the prism structure of the second vessel 631. The second vessel 631 is sized to insert into the second vessel 631 holder 632 for storage. The second vessel 631 structure 612 refills the second vessel 631 with water 910 when the second vessel 631 inserts into the second vessel 631 holder 632. The second vessel 631 further comprises a second vessel 631 valve 633.

The second vessel 631 valve 633 forms a portion of a fitting that attaches the second vessel 631 to the second retractable hose 425 such that the second vessel 631 receives water 910 from the second retractable hose 425. The second vessel 631 valve 633 forms a fluidic connection to the second retractable hose 425 when the second vessel 631 inserts into the second vessel 631 holder 632. The second vessel 631 valve 633 mounts in the closed congruent end of the pan structure of the second vessel 631.

The second vessel 631 holder 632 is a mechanical structure. The second vessel 631 holder 632 mounts in the item of furniture 777 such that the second vessel 631 holder 632 and the second vessel 631 are accessible from within the item of furniture 777. The second vessel 631 holder 632 stores the second vessel 631. The second vessel 631 holder 632 transfers water 910 from the second retractable hose 425 into the second vessel 631. The second vessel 631 holder 632 further comprises a second vessel 631 holder 632 valve 634 and a second vessel 631 holder 632 pan 635.

The second vessel 631 holder 632 valve 634 forms a portion of a fitting that attaches the second vessel 631 to the second retractable hose 425 such that the second vessel 631 receives water 910 from the second retractable hose 425. The second vessel 631 holder 632 valve 634 attaches to the second retractable hose 425. The second vessel 631 holder 632 valve 634 mounts in the closed congruent end of the pan structure formed by the second vessel 631 holder 632 pan 635 such that the second vessel 631 valve 633 inserts into the second vessel 631 holder 632 valve 634 as the second vessel 631 inserts into the second vessel 631 holder 632 pan 635. The insertion of the second vessel 631 valve 633 into the second vessel 631 holder 632 valve 634 forms the fluidic connection that allows the second retractable hose 425 to refill the second vessel 631 with water 910.

The second vessel 631 holder 632 pan 635 is a prism-shaped negative space that is formed in the second vessel 631 holder 632. The second vessel 631 holder 632 pan 635 has a pan structure. The second vessel 631 holder 632 pan 635 is geometrically similar to the second vessel 631. The inner dimension of the second vessel 631 holder 632 pan 635 is greater than the outer dimension of the second vessel 631 such that the second vessel 631 inserts into the second vessel 631 holder 632 pan 635.

The following definitions were used in this disclosure:

Activated Carbon: As used in this disclosure, activated carbon is a form of carbon that is processed in a manner that presents a large surface area for chemical interactions. The surface of activated carbon is used to adsorb chemical contaminants from a fluid flow that is passed through the activated carbon.

Aperture: As used in this disclosure, an aperture is a prism-shaped negative space that is formed completely through a structure or the surface of a structure.

Ball Valve: As used in this disclosure, a ball valve is a type of commercially available check valve.

Bed Filter: As used in this disclosure, a bed filter comprises a particulate material through which a fluid is passed such that particulate material captures solids contained within the fluid while allowing the fluid itself to pass through the particulate matter.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drinking Water: As used in this disclosure, drinking water is water that is deemed safe for drinking or use in cooking by humans. A synonym of drinking water is potable water.

Feedback: As used in this disclosure, feedback refers to a system, including engineered systems, or a subsystem further comprising an "input" and an "output" wherein the difference between the output of the engineered system or subsystem and a reference is used as, or fed back into, a portion of the input of the system or subsystem. Examples of feedback in engineered systems include, but are not limited to, a fluid level control device such as those typically used in a toilet tank, a cruise control in an automobile, a fly ball governor, a thermostat, and almost any electronic device that comprises an amplifier. Feedback systems in nature include, but are not limited to, thermal regulation in animals and blood clotting in animals (wherein the platelets involved in blood clotting release chemical to attract other platelets)

Filter: As used in this disclosure, a filter is a mechanical device that is used to separate solids that are suspended in a liquid or a gas. A strainer is type of filter with what would be considered a coarse mesh measurement.

Fitting: As used in this disclosure, a fitting is a component that is attached to a first object. The fitting is used to forming a fluidic connection between the first object and a second object.

Float Switch: As used in this disclosure, a float switch is a commercially available switch that is actuated by the level of liquid contained within a contained space. A common use of a float switch is in the operation of a bilge or sump pump. Specifically, when the level of accumulated liquid in a bilge or a sump exceeds a predetermined level, the float switch will actuate into a closed position that completes an electric circuit that provides electrical power to a pump that will remove the liquid from the bilge or sump. When the accumulated liquid falls below the predetermined level the float switch will actuate into an open position discontinuing the operation of the pump.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Series Circuit: As used in this disclosure, a fluid series circuit refers to a method of connecting a plurality of fluid network elements that are connected to form a single fluid transport path from a first point to a second point in a fluid network.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Gas: As used in this disclosure, a gas refers to a state (phase) of matter that is fluid and that fills the volume of the structure that contains it. Stated differently, the volume of a gas always equals the volume of its container.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Inner Dimension: As used in this disclosure, the term inner dimension describes the span from a first inside or interior surface of a container to a second inside or interior surface of a container. The term is used in much the same way that a plumber would refer to the inner diameter of a pipe.

Liquid: As used in this disclosure, a liquid refers to a state (phase) of matter that is fluid and that maintains, for a given pressure, a fixed volume that is independent of the volume of the container.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Phase: As used in this disclosure, phase refers to the state of the form of matter. The common states of matter are solid, liquid, gas, and plasma.

Port: As used in this disclosure, a port is an aperture formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Recline: As used in this disclosure, recline refers to a person who lies backwards with the back supported. A person in such a position is said to be in a reclined position. Alternatively, recline may refer to a seat or chair wherein the back of the seat is in a sloped position such that a person sitting in the seat is in a reclined position. Such a seat or chair is often referred to as a reclining chair, a reclining seat, or a recliner.

Reservoir: As used in this disclosure, a reservoir refers to a container or containment system that is configured to store a liquid.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Valve: As used in this disclosure, a valve is a device that is used to control the flow of a fluid (gas or liquid) through a pipe, tube, or hose.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A water-dispensing system for furniture comprising
- a water storage reservoir, a pump, a valve, a first retractable hose, and a second retractable hose;
- wherein the water-dispensing system for furniture further comprises a plurality of vessel structures;
- wherein each of the plurality of vessel structures is a mechanical structure that contains the water;
- wherein the plurality of vessel structures automatically refills the water;
- wherein the water-dispensing system for furniture is configured for use with an item of furniture;
- wherein the water-dispensing system for furniture mounts in the item of furniture;
- wherein the plurality of vessel structures further comprises a first vessel structure;
- wherein the first vessel structure further comprises a first vessel and a first vessel holder;
- wherein the first vessel holder contains the first vessel;
- wherein the first vessel holder further comprises a first vessel holder valve and a first vessel holder pan;
- wherein the first vessel holder pan is a prism-shaped negative space that is formed in the first vessel holder;
- wherein the first vessel holder valve forms a portion of a fitting that attaches the first vessel to the first retractable hose such that the first vessel receives water from the first retractable hose;
- wherein the inner dimension of the first vessel holder pan is greater than the outer dimension of the first vessel such that the first vessel inserts into the first vessel holder pan.

2. The water-dispensing system for furniture according to claim 1 wherein the pump and the valve control the flow of water from the water reservoir, through the pump and the valve into the plurality of vessel structures.

3. The water-dispensing system for furniture according to claim 2
- wherein the plurality of vessel structures is a mechanical structure;
- wherein the plurality of vessel structures forms a vessel from which the water is consumed;
- wherein the plurality of vessel structures provides a storage space for the vessel;

wherein the plurality of vessel structures provides a mechanism that refills the vessel with water.

4. The water-dispensing system for furniture according to claim 3 wherein each of the plurality of vessel structures mounts in the item of furniture such that the vessel is accessible.

5. The water-dispensing system for furniture according to claim 4 wherein the open face of the pan structure of the first vessel is formed in a congruent end of the prism structure of the first vessel.

6. The water-dispensing system for furniture according to claim 5 wherein the first vessel is sized to insert into the first vessel holder for storage;

wherein the first vessel holder stores the first vessel;

wherein the first vessel structure refills the first vessel with water when the first vessel inserts into the first vessel holder.

7. The water-dispensing system for furniture according to claim 6 wherein the first vessel further comprises a first vessel valve;

wherein the first vessel valve forms a portion of a fitting that attaches the first vessel to the first retractable hose such that the first vessel receives water from the first retractable hose;

wherein the first vessel valve forms a fluidic connection to the first retractable hose when the first vessel inserts into the first vessel holder;

wherein the first vessel valve mounts in the closed congruent end of the pan structure of the first vessel.

8. The water-dispensing system for furniture according to claim 7 wherein the first vessel holder is a mechanical structure;

wherein the first vessel holder mounts in the item of furniture such that the first vessel holder and the first vessel are accessible from within the item of furniture;

wherein the first vessel holder transfers water from the first retractable hose into the first vessel.

9. The water-dispensing system for furniture according to claim 8 wherein the first vessel holder valve attaches to the first retractable hose;

wherein the first vessel holder valve mounts in the closed congruent end of the pan structure formed by the first vessel holder pan such that the first vessel valve inserts into the first vessel holder valve as the first vessel inserts into the first vessel holder pan;

wherein the insertion of the first vessel valve into the first vessel holder valve forms the fluidic connection that allows the first retractable hose to refill the first vessel with water.

10. The water-dispensing system for furniture according to claim 9 wherein the first vessel holder pan is a prism-shaped negative space that is formed in the first vessel holder;

wherein the first vessel holder pan has a pan structure;

wherein the first vessel holder pan is geometrically similar to the first vessel.

11. The water-dispensing system for furniture according to claim 10 wherein the plurality of vessel structures further comprises a second vessel structure;

wherein the second vessel structure further comprises a second vessel and a second vessel holder;

wherein the second vessel holder contains the second vessel.

12. The water-dispensing system for furniture according to claim 11 wherein the second vessel is a hollow prism-shaped structure;

wherein the second vessel is a pan-shaped structure;

wherein the open face of the pan structure of the second vessel is formed in a congruent end of the prism structure of the second vessel.

13. The water-dispensing system for furniture according to claim 12 wherein the second vessel is sized to insert into the second vessel holder for storage;

wherein the second vessel holder stores the second vessel;

wherein the second vessel structure refills the second vessel with water when the second vessel inserts into the second vessel holder.

14. The water-dispensing system for furniture according to claim 13 wherein the second vessel further comprises a second vessel valve;

wherein the second vessel valve forms a portion of a fitting that attaches the second vessel to the second retractable hose such that the second vessel receives water from the second retractable hose;

wherein the second vessel valve forms a fluidic connection to the second retractable hose when the second vessel inserts into the second vessel holder;

wherein the second vessel valve mounts in the closed congruent end of the pan structure of the second vessel.

15. The water-dispensing system for furniture according to claim 14 wherein the second vessel holder is a mechanical structure;

wherein the second vessel holder mounts in the item of furniture such that the second vessel holder and the second vessel are accessible from within the item of furniture;

wherein the second vessel holder transfers water from the second retractable hose into the second vessel.

16. The water-dispensing system for furniture according to claim 15 wherein the second vessel holder further comprises a second vessel holder valve and a second vessel holder pan;

wherein the second vessel holder pan is a prism-shaped negative space that is formed in the second vessel holder;

wherein the second vessel holder valve forms a portion of a fitting that attaches the second vessel to the second retractable hose such that the second vessel receives water from the second retractable hose;

wherein the inner dimension of the second vessel holder pan is greater than the outer dimension of the second vessel such that the second vessel inserts into the second vessel holder pan.

17. The water-dispensing system for furniture according to claim 16 wherein the second vessel holder valve attaches to the second retractable hose;

wherein the second vessel holder valve mounts in the closed congruent end of the pan structure formed by the second vessel holder pan such that the second vessel valve inserts into the second vessel holder valve as the second vessel inserts into the second vessel holder pan;

wherein the insertion of the second vessel valve into the second vessel holder valve forms the fluidic connection that allows the second retractable hose to refill the second vessel with water.

18. The water-dispensing system for furniture according to claim 17 wherein the second vessel holder pan is a prism-shaped negative space that is formed in the second vessel holder;

wherein the second vessel holder pan has a pan structure;

wherein the second vessel holder pan is geometrically similar to the second vessel.

* * * * *